US005471201A

United States Patent [19]

Cerami et al.

[11] Patent Number: 5,471,201

[45] Date of Patent: Nov. 28, 1995

[54] METHOD AND APPARATUS FOR MONITORING THE OPERATING CONDITION OF LAMPS IN A PUBLIC LIGHTING NETWORK

[75] Inventors: Pietro Cerami, Seregno; Pierluigi Gatti, Bresso; Pierluigi Melis, Milan, all of Italy

[73] Assignee: Schlumberger Industries S.r.l., Milan, Italy

[21] Appl. No.: 65,002

[22] Filed: May 24, 1993

[30] Foreign Application Priority Data

Jun. 3, 1992 [IT] Italy ..... MI92A1368

[51] Int. Cl.[6] ..... G08B 21/00

[52] U.S. Cl. ..... 340/641; 340/635; 340/458

[58] Field of Search ..... 340/641, 642, 340/635, 458; 315/151, 292, 308, 316; 324/403, 414

[56] References Cited

U.S. PATENT DOCUMENTS 5,095,502 3/1992 Finzel ..... 340/641

5,202,636 4/1993 Powell ..... 340/641

*Primary Examiner*—Edward L. Coles, Sr.

*Assistant Examiner*—Thomas D. Lee

*Attorney, Agent, or Firm*—Sanford J. Asman

[57] ABSTRACT

An apparatus for monitoring the state of operation of lamp (2) in a public lighting network is provided comprising a sensing unit (6) associated with each lamp (2) for measuring the voltage of and luminous flux emitted by each lamp (2). Each sensing unit (6) also calculates the efficiency of lamp using an efficiency index given by the gradient of the line which, in a Cartesian diagram in which the voltage of the lamp is the x-coordinate and the flux the y-coordinate, represents the instantaneous relationship between the parameters.

15 Claims, 3 Drawing Sheets

METHOD AND APPARATUS FOR MONITORING THE OPERATING CONDITION OF LAMPS IN A PUBLIC LIGHTING NETWORK

FIELD OF THE INVENTION

The present invention relates to a method and apparatus for monitoring the operating condition of a lamp in a public lighting network, applicable both to installations with gas discharge lamps and to installations with incandescent lamps.

BACKGROUND OF THE INVENTION

In order to verify the possible necessity of replacing a lamp in public lighting installations, reliance is generally placed on direct observation either by teams of monitoring staff or by private citizens who take it upon themselves to notify faults to the network management authority.

In addition to this, so-called 'remote monitoring' systems have been available for some time which comprise an electronic network to sense the state of operation of the individual lamps. All the information collected on an entire lighting network is then directed to a single central monitoring station. Systems of this type are described, for example, in patent documents EP-A1-0347317, FR-B1-2592718, FR-A1-2646581, DE-A1-3635682, U.S. Pat. No. 4,939,505, IT-B-1227507, IT-B-1229228.

The above-mentioned systems very in the manner in which they sense whether the lamp is on or off. In particular, in some examples, monitoring is based on current sensing (IT-B-1227507, IT-B-1229228), in others on sensing the voltage at the lamp terminals (IT-B-1229228 again), in others on sensing the luminous flux (FR-B1-2592718), and in others on sending test signals (U.S. Pat. No. 4,939,505, EP-A1-0347317). The system described in FR-A1-2646581 uses current sensing to determine whether the lamp is on, but a fault signal is not sent until it is verified that an appropriate voltage is present; this prevents drops in line voltage from causing generalized signaling of non-existent faults.

It has, however, been found that lamp failure is almost never an unexpected phenomenon. In fact, emission of light progressively decreases as the lamp ages. Indeed, in some types of gas discharge lamps complete failure is preceded by a period of intermittent operation, during which the functionality of the lamp may be considered to have come to an end, although current and voltage values do not deviate significantly from those of efficient lamps.

SUMMARY OF THE INVENTION

The problem underlying this invention is to monitor not only whether each lamp is on or off, but also its actual 'state of health' so that it is possible to arrange for the replacement not only of failed lamps but also of lamps which are so old as to be barely effective and close to complete failure.

The problem is solved according to the invention by a method of monitoring the state of operation of a lamp in a public lighting network, characterized in that an efficiency index for the lamp is determined. The efficiency index is given by the gradient of the line which, in a Cartesian diagram on which the voltage at the terminals of the lamp is plotted as the x-coordinate and the luminous flux emitted by the lamp as the y-coordinate, represents the instantaneous relationship between such parameters.

A lamp has an intensity of emitted luminous flux which is dependent upon the voltage which is applied according to a function which, within the limits of normal use of a lamp, is comparable with a linear function. Thus, if luminous flux intensity is plotted as the y-coordinate on a Cartesian diagram and voltage as the x-coordinate, a line is obtained which has a positive gradient and intersects the voltage axis at a characteristic point, which at a certain voltage corresponds to zero intensity of the luminous flux. As the lamp ages, the curve flattens, i.e. the gradient of the line gradually decreases, while still passing through the above-mentioned characteristic point. At limit conditions, when the lamp has failed, the curve coincides with the x-axis.

In this invention, since the gradient of the flux intensity/voltage curve, or the luminous efficiency of the lamp, is monitored, it becomes possible to know at any instant the state of aging of the lamp. This would not be possible by considering solely the intensity of the luminous flux emitted by the lamp, since it would not be possible to take into account the variations in intensity due not to aging but to normal variations in voltage which occur on the supply network.

The voltage at the lamp terminals may be measured as the overall voltage applied to the combination of the light tube and the accessory components required for its operation (starter, ballasts, capacitors).

To calculate the efficiency index, it is preferred to proceed using the stages of: sensing the voltage at the lamp terminals and the intensity of the luminous flux emitted by the lamp when a new lamp is installed, storing such values as the first reference voltage and the first reference luminous flux intensity, which may be represented as a first reference point on the Cartesian diagram, sensing at each moment the voltage at the lamp terminals and the intensity of the luminous flux emitted by the lamp, which may be represented as a working point on the Cartesian diagram, comparing the present voltage with the first reference voltage, waiting until the difference between the present voltage and the first reference voltage exceeds a preset value, storing this changed voltage and the corresponding intensity of luminous flux emitted as the second reference voltage and the second reference luminous flux intensity, which may be represented as a second reference point on the Cartesian diagram, establishing a third reference point as the meeting point between the voltage axis and the line passing through the first and second reference points, calculating at each moment the efficiency index of the lamp as the ratio between the angular coefficient of the line joining the first and third reference points and the line joining the third reference point with the working point.

This allows the gradient of the flux/voltage line to be calculated in a simple manner. In order to do this, the calculation establishes the so-called third reference point, namely the voltage associated with zero flux. In fact, as already stated, this point is substantially fixed and is not dependent upon lamp aging. To find this point, as the intersection between the voltage axis and the characteristic operating line of the new lamp, the first significant fall in voltage on the line may be used by reading, storing and appropriately processing the voltage and luminous flux intensity values.

Falls in voltage sufficient to bring about the above process are very frequent on electricity supply lines for public lighting lamps, due, if for no other reason, to the major and sudden changes in load occurring when a large number of lamps are simultaneously switched on or off. It is thus highly probable that a suitable change in voltage will occur within the first moments of life of the installed lamp.

However, were the network voltage to be very stable, it could happen that the third reference point would be noted only once the lamp had already partially aged. In order to take this into account, it is preferable to be able to use an alternative index of efficiency according to the following stages: sensing the voltage at the lamp terminals and the intensity of the luminous flux emitted by the lamp when a new lamp is installed, storing such values as the first reference voltage and the first reference luminous flux intensity, which may be represented as a first reference point on the Cartesian diagram, sensing at each moment the voltage at the lamp terminals and the intensity of the luminous flux emitted by the lamp, which may be represented as a working point on the Cartesian diagram, comparing the present voltage with the first reference voltage and, for as long as the difference between the present voltage and the first reference voltage remains below a preset value, calculating at each moment a preliminary efficiency index of the lamp as the ratio between the present luminous flux intensity and the first reference flux intensity, storing the latest luminous flux intensity, which may be represented together with the present voltage by a fourth reference point on the diagram, gradually updated as the luminous flux intensity changes, and when the difference between the present voltage and the first reference voltage exceeds the said preset value, storing this changed voltage and the corresponding intensity of luminous flux emitted as the second reference voltage and the second reference luminous flux intensity, which may be represented as a second reference point on the Cartesian diagram, establishing a third reference point as the meeting point between the voltage axis and the line passing through the fourth and second reference point, calculating at each moment the efficiency index of the lamp as the ratio between the angular coefficient of the line joining the first and third reference points and the line joining the third reference point with the working point.

In this way, efficiency is assessed in two different manners before and after the third reference point is established. It should, however, be noted that the preliminary index calculated during the initial stage is not at all in contrast with the subsequently calculated index. The preliminary index is simply calculated in a more direct manner because at this stage it is not necessary to take variations in voltage into account since the voltage is substantially constant.

Even if the third reference point were available (for example as a result of specific testing before installation) and it were therefore possible immediately to calculate the reference index in a complete manner, its value would be exactly the same as the preliminary index calculated in the above-mentioned manner.

In each case, the indication supplied is related to the time at which the lamp was new and is therefore a relative indication of the aging of the lamp itself. Furthermore, precisely because it is relative to the initial conditions, the indication is not significantly affected by aging of the components of the sensing system.

In order to implement the above process, there is proposed according to the invention an apparatus for monitoring the state of operation of individual lamps in a public lighting network comprising: a sensing unit for each lamp, a concentrator to exchange information with a plurality of sensing units, the apparatus being characterized by the sensing unit sensing at each moment the voltage at the terminals of the lamp and the intensity of the luminous flux emitted by the lamp. The apparatus calculates an efficiency index of the lamp given by the gradient of the line which, in a Cartesian diagram on which the voltage at the terminals of the lamp is shown as the x-coordinate and the luminous flux emitted by the lamp as the y-coordinate, represents the instantaneous relationship between such parameters.

The calculation of the efficiency index of the lamp may be performed by a microprocessor located at the sensing unit or, alternatively, the concentrator. In the latter case, the sensing unit merely transmits the voltage and flux values for later calculation of the efficiency index by the concentrator.

Measurement of the intensity of the luminous flux is particularly delicate, in that the photosensitive components which are normally available at reasonable cost (photodiodes) are not capable of withstanding high temperatures and are therefore ill suited to being accommodated directly within the lamp housing. In order to overcome this problem, the sensing of the intensity of the luminous flux emitted by the lamp is preferably performed by a photosensitive component located outside the lamp linked optically with the inside of the lamp by an optical fiber bundle.

Still more preferably, since optical fibers also have limited heat resistance, the optical fiber bundle is linked optically with the inside of the lamp housing via a heat-resistant optical terminal.

Advantageously, the heat-resistant terminal consists of a substantially L-shaped transparent component, with a first arm facing towards the inside of the lamp housing, a second arm outside the lamp housing connected to the optical fiber bundle and an intermediate section having an inclined reflective surface to transmit the light from the first to the second arm.

Communication between the sensing unit, the concentrators and central monitoring station may be achieved in various ways. Preferably, the concentrator communicates with the sensing units by modulated waves transmitted along the electrical power supply line to the lamp. However, in alternative embodiments a radio frequency link may be established between the sensing units and the concentrator. Preferably, a central monitoring station may be provided which communicates with the concentrators by a switched or dedicated line, radio links or modulated waves. The data transmission network established for monitoring the state of operation of lamps may advantageously also be used for other purposes, whether or not connected with operation of the lamps.

For example, the sensor unit advantageously may also comprise switches means for remotely controlling the power supply to the lamp; this makes it possible, for example, to cut off the power supply to a defective lamp. Or the sensing unit may also advantageously comprise an auxiliary input to acquire data from a device for sensing parameters unrelated to the aging of the lamp, such as the presence of fog or rain, ambient temperature, concentration of pollutants, sound levels etc. These elements of the sensor unit may be controlled or may pass information to the appropriate concentrator, as required.

BRIEF DESCRIPTION OF THE DRAWINGS

Further features and advantages of the invention may be found in the following description of an installation according to one embodiment of the invention given by way of example only and illustrated in the attached figures.

DETAILED DESCRIPTION

Figure 1:
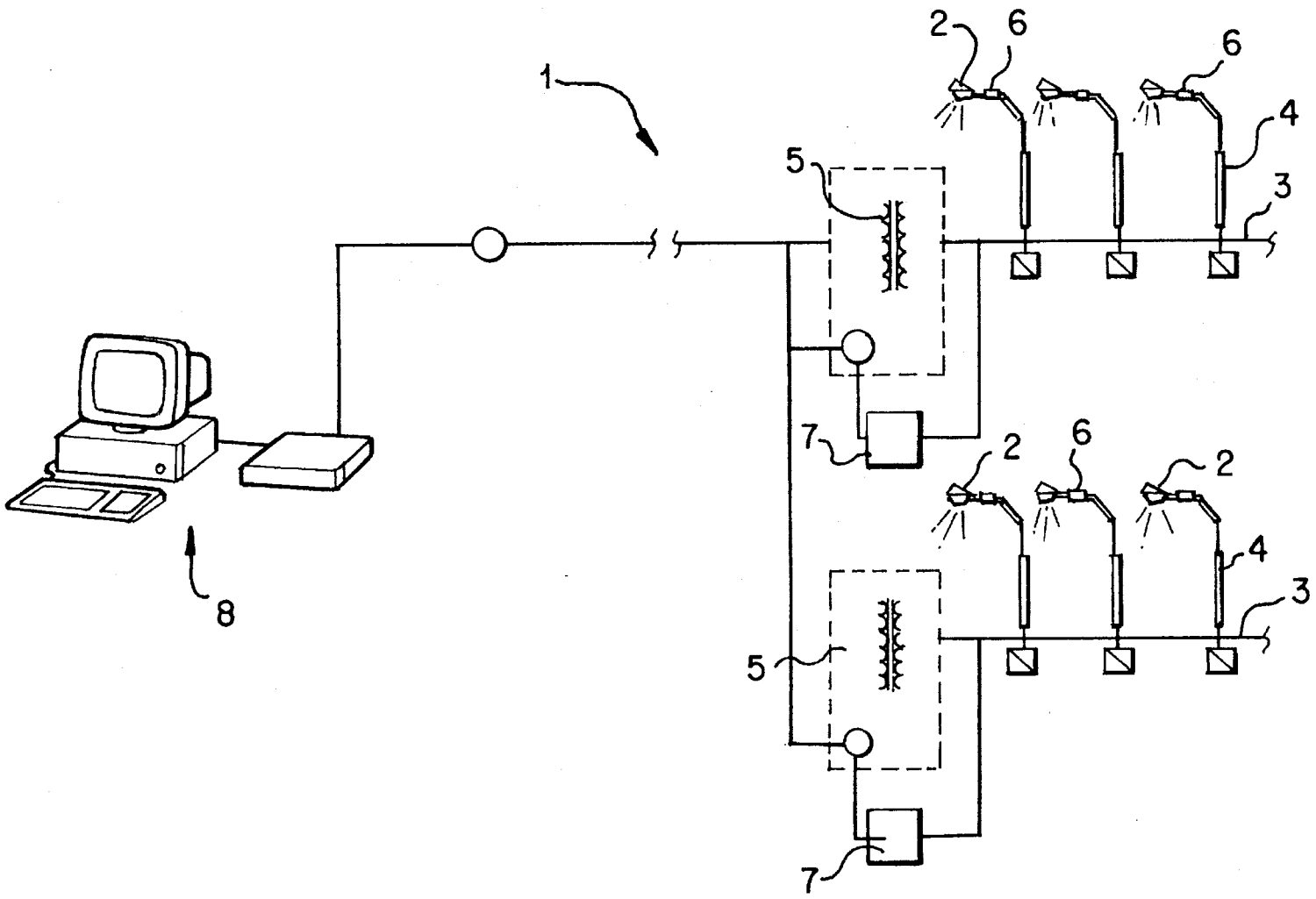
FIG. 1 is a schematic diagram of an installation according to the invention.

In the figures, 1 indicates the total installation for monitoring the state of operation of individual lamps 2, for example gas discharge lamps, in a public lighting network. Such a network comprises a plurality of electric lines 3, each with a plurality of lamps 2 installed on poles 4 and a transformer/distribution station 5 to supply electric power to the lamps 2.

The installation 1 comprises a plurality of sensing units 6, one for each lamp 2, and a plurality of concentrators 7, one for each electric line 3. The installation 1 additionally comprises a single central monitoring station 8. The units 6, the concentrators 7 and the central station 8 exchange information and signals. Communication between the units 6 and the corresponding concentrators 7 is preferably achieved via the same electric power supply line, downstream from the stations 5 using modulated wave technology. This technology is already known per se and will not be illustrated in the context of this description. Communication between the concentrators 7 and the central station 8 may be achieved via a conventional data transmission line, such as a switched telephone line or a dedicated line, or via a radio link.

Figures 2, 3:
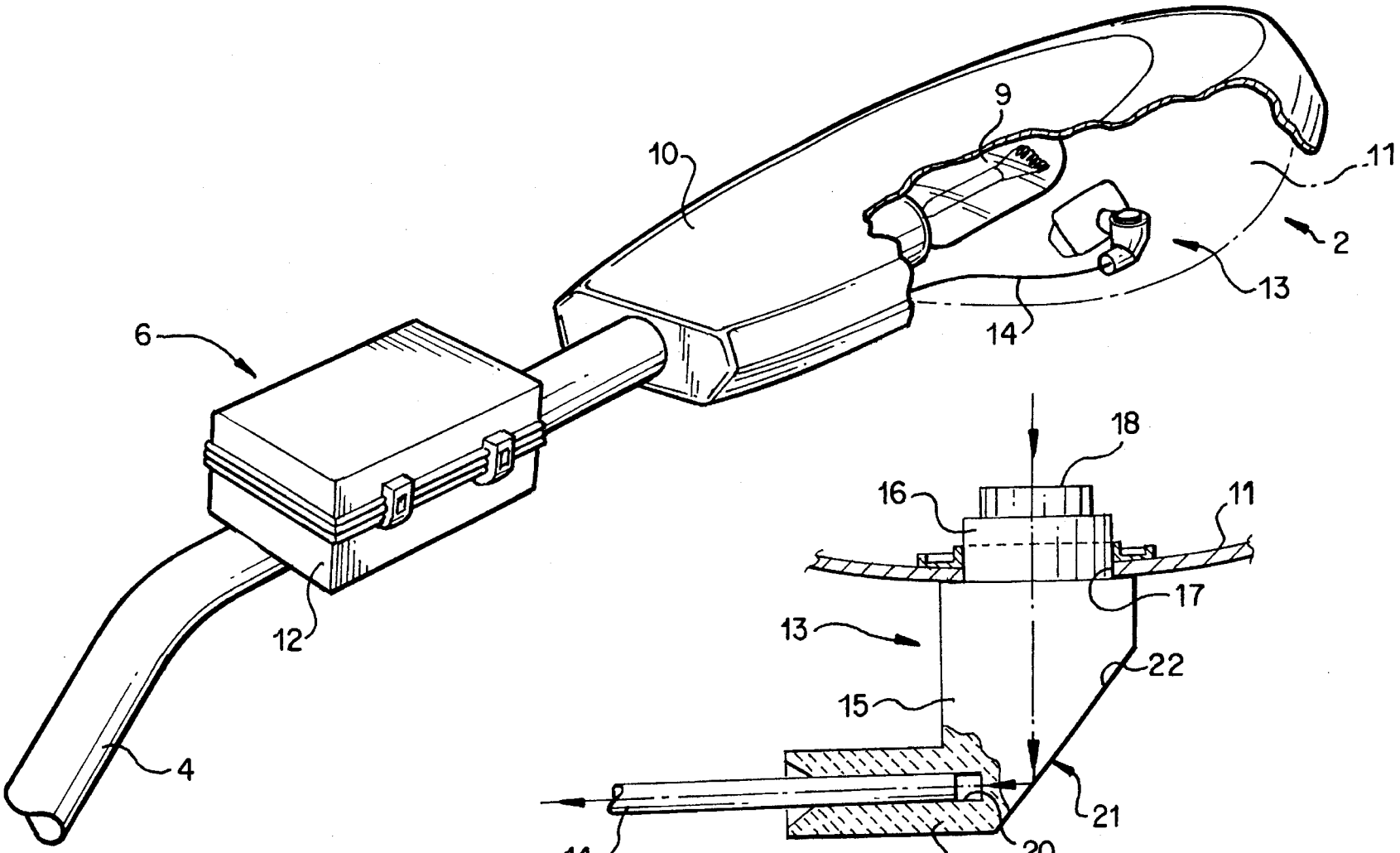
FIG. 2 is a perspective view of a lamp of the installation according to FIG. 1.
FIG. 3 is a cross-sectional view of a detail of the lamp according to FIG. 2.

Referring to FIG. 2, each lamp 2 comprises an illuminating component 9 of the gas discharge type provided with the accessory components for its operation (starter, ballasts, capacitors), which are not shown in the figures. The lamp 2 is accommodated in a lamp housing 10, which is fitted at the top of the pole 4 and comprises a reflector (or so-called parabolic reflector) 11 around the illuminating component 9. The reflector 11 may or may not be enclosed with a protective glass (not illustrated). The pole 4 bears, close to the lamp housing 10, a sealed casing 12 which accommodates a sensing unit 6.

Each sensing unit 6 senses the voltage at the terminals of the lamp 2, senses for sensing the intensity of the light flux emitted by the lamp 2 and calculates a monitoring parameter for the state of the lamp 2, which parameter is substantially directly proportional to luminous flux and inversely proportional to voltage.

The voltage at the terminals of the lamp 2 is sensed, for example, by the power supply transformer of the unit 6. The sensing of the intensity of the luminous flux emitted by the lamp 2 may be performed by a photosensitive component (not illustrated), such as for example a photodiode, accommodated within the casing 12, a heat-resistant terminal 13 and an optical fiber bundle 14, which optically connects the terminal 13 with the photosensitive component. The terminal 13 consists of a transparent component 15 made from a plastic material capable of withstanding high temperatures (at least 150° C.), such as a polycarbonate or better a polyester-carbonate. The component 15 is substantially L-shaped. A first arm 16 of the component 15 faces towards the inside of the reflector 11 of the lamp 2 through an appropriate hole 17, and has a light-collecting face 18 directed towards the illuminating component 9. A second arm 19 of the component 15 is outside the reflector 11 and has a cylindrical seat 20 for connection with the optical fiber bundle 14. Between the two arms 16 and 19, the transparent component 15 has an intermediate section 21 accommodating an inclined reflective surface 22 to transmit the light from the first arm 16 to the second arm 19. The light-collecting face 18 is advantageously convex so as to act as a converging lens, thus favoring light collection.

Each sensing unit 6 may further comprise a switch for remote control of the power supply to the lamp 2; such switches, which are known per se, comprise for example a simple relay (not illustrated).

Furthermore, each sensing unit 6 may comprise an auxiliary input for the acquisition of analog or digital parameters which are independent of the lamp 2. The parameters may come from ambient temperature thermometer, a fog sensor, a rain sensor, a sound level meter, a pollutant analyzer or other devices. The data collected by these devices may be transmitted in the same manner as the data relating to the state of operation of the lamps; they may also be used for managing the light, particularly for switching them on in particular situations.

Figure 4:
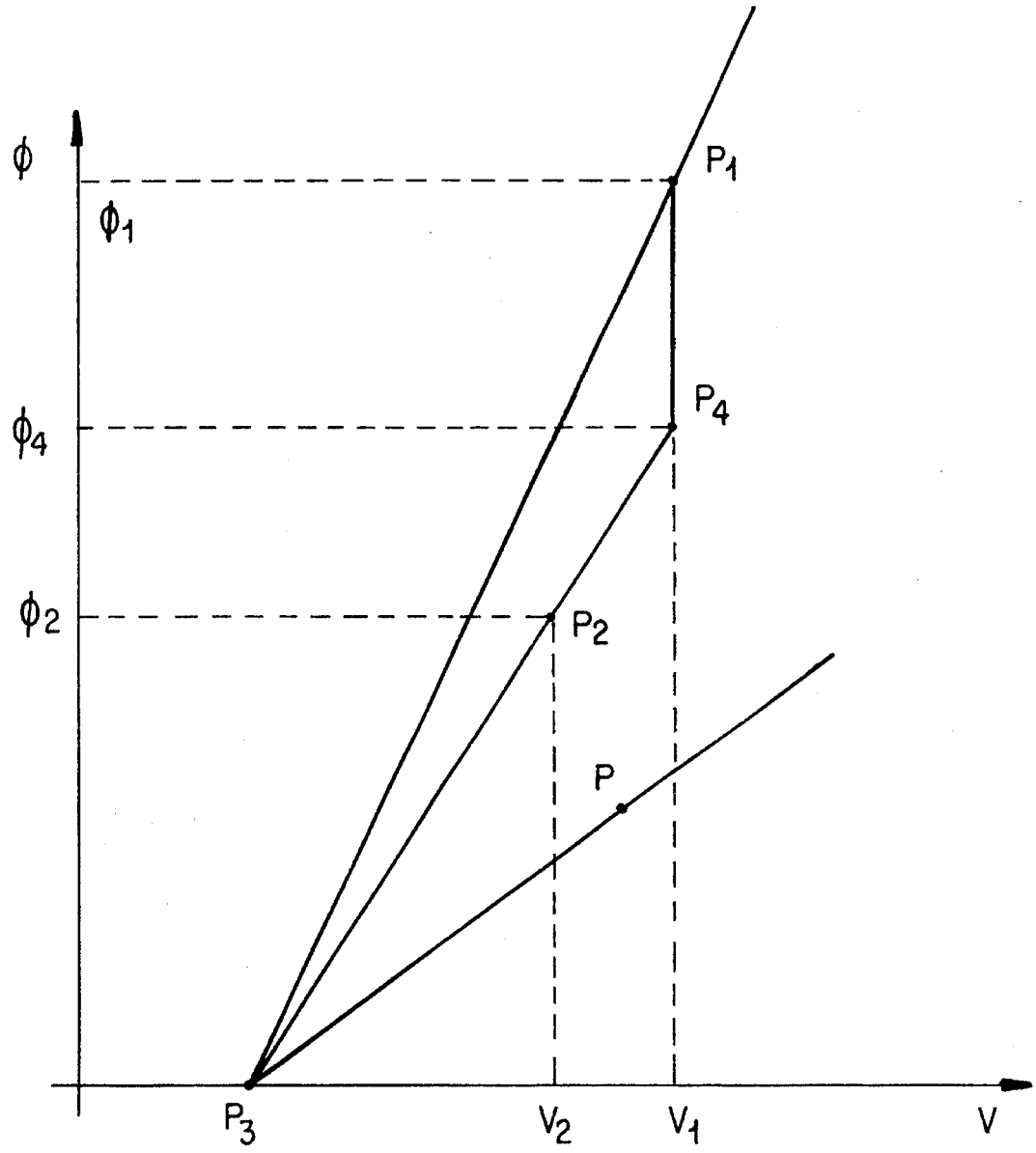
FIG. 4 is a diagram illustrating the process for calculating the efficiency index of the lamp.

In operation, each concentrator 7 requests, periodically or on a specific command, each of the sensing units 6 connected to it to provide information on the condition of the monitored lamp 2; such information consists of the value of the efficiency index calculated by the unit 6 and of an indication of the possible intermittent operation of the lamp itself. Calculation of the efficiency index is performed in the following manner, with reference to FIG. 4.

First of all, the voltage at the terminals of the lamp and the intensity of the luminous flux emitted by the lamp are sensed when a new lamp is installed. These values are stored as the first reference voltage V1 and the first reference luminous flux intensity Φ1. On the Cartesian diagram in FIG. 4, in which voltage V is plotted as the x-coordinate and luminous flux intensity Φ as the y-coordinate, the values V1 and Φ1 constitute a first reference point P1.

Thereafter, voltage V and luminous flux intensity Φ are sensed at every moment and are represented by a working point P on the above-mentioned diagram. The present voltage V is compared with the first reference voltage V1. For as long as the difference between the present voltage and the first reference voltage remains below a preset value, a preliminary lamp efficiency index Dp is calculated at each moment, which index is proportional to the ratio between the present luminous flux intensity and the first reference flux intensity, namely $Dp=k\ (\Phi/\Phi 1)$.

At this stage, the last measured luminous flux intensity Φ is stored as Φ4, which together with V1 establishes a fourth reference point P4 on the diagram. Φ4 is gradually updated as the intensity of the luminous flux varies.

When the difference between the present voltage V and the first reference voltage V1 is greater than the preset value, the changed voltage and the corresponding emitted luminous flux intensity are stored as a second reference voltage V2 and a second reference luminous flux intensity Φ2, which may be represented by a second reference point P2 on the diagram. It is now possible to establish a third reference point P3 as the meeting point between the voltage axis and the line passing through the fourth and second reference point, P4 and P2.

Once P3 has been established, the efficiency index D may be calculated at each moment as the ratio between the angular coefficient of the line joining the first and third reference points P1 and P3 and the line joining the third reference point P3 with the working point P.

After simple algebraic calculations, it is found that the efficiency index may be calculated as:

$$D=k\ [\Phi.(V2-V1)]/[\Phi2.(V-V1)-\Phi1.(V-V2)]$$

From a comparison of the two formulae, it is immediately apparent as long as V=V1 (initial stage) they both provide the same result, independently of the values V1 and Φ2, which are unknown.

The instantaneous values of the efficiency index are transmitted from the units 6 to the respective concentrators 7. Each concentrator 7 then sends the collected data to the central monitoring station 8, where they are processed according to the specific requirements. In particular, the values of the efficiency indices are compared with the preset reference values, and, on the basis of the comparison, the state of health of each lamp may be assessed by the operators. If the value is below a threshold limit it may be appropriate to replace the lamp. Moreover, anomalous situations may be displayed on screen, all or selected information may be printed, the data may be stored to create a historic record which may be referred to for maintenance planning, etc.

It is then possible to 'send signals from the central monitoring station 8 to the concentrators 7 and from these to the units 6, for example to switch individual lamps on or off.

The central monitoring station 8 may be programmed to take decisions automatically on the basis of the information received, for example to cut off the electric power supply to an intermittently operating lamp (if it were to be considered more hazardous to have a flickering light rather than no illumination).

The central monitoring station 8 may be required to correct the efficiency indices supplied by the units 6. For example, were a lamp which was not new to be installed, the central station 8 could be requested to reduce the efficiency index supplied by unit 6 by a certain factor, unit 6 automatically assuming each lamp installed to be at maximum efficiency. A similar situation, extended to all the lamps, is found where an installation according to the invention is installed on an existing lighting network.

Moreover, and as discussed above apart from the data on the lamps, other data may be acquired using appropriate sensors and sensed via the auxiliary inputs. Automatic lighting of the lamps may thus be programmed depending on environmental conditions, for example in rain or fog.

We claim:

1. A method of monitoring a state of operation of a lamp in a public lighting network, comprising the steps of:

sensing a voltage at terminals of the lamp;

sensing intensity of luminous flux emitted by the lamp when the lamp is first installed;

storing the voltage at the lamp as a first reference voltage;

storing the luminous flux as a first reference luminous flux intensity, which may be represented as a first reference point on a Cartesian diagram having a voltage axis along an x-axis and an intensity axis along a y-axis;

sensing at each moment a present voltage at the lamp terminals and a present intensity of the luminous flux emitted by the lamp, with the present voltage and the present intensity at each moment being represented as a working point on the Cartesian diagram;

comparing the present voltage with the first reference voltage;

waiting until a moment when a difference between the present voltage and the first reference voltage exceeds a preset value;

storing the voltage at that moment and the intensity of luminous flux emitted at that moment as the second reference voltage and the second reference luminous flux intensity, which may be represented as a second reference point on the Cartesian diagram;

establishing a third reference point as a meeting point between the voltage axis and a line passing through the first and second reference points;

calculating at each moment an efficiency index of the lamp as ratio between an angular coefficient of a line joining the first and third reference points and a line joining the third reference point with the working point.

2. A method of monitoring a state of operation of a lamp in a public lighting network, comprising the steps of:

sensing a voltage at terminals of the lamp;

sensing an intensity of luminous flux emitted by the lamp when the lamp is first installed;

storing the voltage at the terminals of the lamp as a first reference voltage and storing the intensity of the luminous flux as a first reference luminous flux intensity, which may be represented as a first reference point on a Cartesian diagram in which a voltage axis is along an x-axis and an intensity axis is along a y-axis;

sensing at each moment a present voltage at the lamp terminals and a present intensity of the luminous flux emitted by the lamp, with the voltage and intensity at each moment being represented as a working point on the Cartesian diagram;

comparing the present voltage with the first reference voltage and, for as long as the difference between the present voltage and the first reference voltage remains below a preset values calculating a preliminary efficiency index of the lamp as a ratio between the present luminous flux intensity and the first reference flux intensity;

storing the present luminous flux intensity which may be represented together with the present voltage as a fourth reference point on the Cartesian diagram;

gradually updating said fourth reference point as the present luminous flux intensity changes;

when the difference between the present voltage at one moment and the first reference voltage exceeds the preset value, storing the present voltage at that one moment and the intensity of luminous flux emitted at that one moment as the second reference voltage and the second reference luminous flux intensity, which may be represented as a second reference point on the Cartesian diagram;

establishing a third reference point as a meeting point between the voltage axis and a line passing through the fourth and second reference points, calculating at each moment an efficiency index of the lamp as a ratio between an angular coefficient of a line joining the first and third reference points and a line joining the third reference point with the working point.

3. Apparatus for monitoring a state of operation of individual lamps in a public lighting network, each lamp having associated power supply terminals across which a voltage may be measured and emitting a characteristic luminous flux, the apparatus comprising:

a sensing unit for each lamp;

at least one concentrator adapted to exchange information with a plurality of sensing units, including information regarding a state of individual lamps;

a central monitoring station adapted to receive information regarding the state of individual lamps from the concentrator;

the apparatus being characterized by the sensing unit for each lamp including sensing means adapted to sense at each moment the voltage at the terminals of the lamp and the intensity of the luminous flux emitted by the lamp, and by calculation means adapted to calculate an efficiency index of the lamp given by the gradient of a line which, in a Cartesian diagram on which the voltage at the terminals of the lamp is shown as an x-coordinate and the luminous flux emitted by the lamp as a y-coordinate, represents an instaneous relationship between such parameters, the calculated efficiency index being available at the central monitoring station to enable evaluation of the state of operation of the individual lamps.

4. An apparatus as claimed in claim 3 in which the concentrator communicates with the sensing units by modulated signals carried along an electricity power supply line for the lamps.

5. An apparatus as claimed in claim 3, in which the central monitoring station communicates and exchanges information with the concentrator through any one of a switched line, a dedicated line, a radio link and a modulated power supply.

6. An apparatus as claimed in claim 3 in which the sensing unit also comprises switching means for enabling remote control of the power supply to the lamp.

7. An apparatus as claimed in claim 3 in which the sensing unit also comprises an auxiliary input to acquire data from a device for sensing parameters unrelated to the lamp.

8. An apparatus as claimed in claim 7, wherein said parameters unrelated to the lamp are any one of the parameters selected from a group comprising fog, rain, ambient temperature, and concentration of pollutants.

9. Apparatus for monitoring a state of operation of individual lamps in a public lighting network, each lamp having associated power supply terminals across which a voltage may be measured and emitting a characteristic luminous flux, the apparatus comprising:

a sensing unit for each lamp;

at least one concentrator adapted to exchange information with a plurality of sensing units, including information regarding a state of individual lamps;

a central monitoring station adapted to receive information regarding the state of individual lamps from the concentrator;

the apparatus being characterized by the sensing unit for each lamp including sensing means adapted to sense at each moment the voltage at the terminals of the lamp and an intensity of the luminous flux emitted by the lamp, and by calculation means adapted to calculate an efficiency index of the lamp given by a gradient of a line which, in a Cartesian diagram on which the voltage at the terminals of the lamp is shown as an x-coordinate and the luminous flux emitted by the lamp as a y-coordinate, represents an instaneous relationship between such parameters, the calculated efficiency index being available at the central monitoring station to enable evaluation of the state of operation of the individual lamps;

wherein said means for sensing the intensity of luminous flux emitted by the lamp comprises a photosensitive component located outside the lamp, optically linked with the inside of the lamp by an optical fiber bundle.

10. An apparatus as claimed in claim 9 in which the lamp comprises a lamp housing, the optical fiber bundle being optically linked with the inside of the lamp housing via a heat-resistant optical terminal.

11. An apparatus as claimed in claim 10 in which the heat-resistant terminal comprises a substantially L-shaped transparent component, with a first arm facing towards the inside of the lamp housing, a second arm outside the lamp housing connected to the optical fiber bundle and an intermediate section accommodating an inclined reflective surface to transmit the luminous flux emitted by the lamp from the first arm to the second arm.

12. A system for monitoring a state of operation of a plurality of lamps in a public lighting network with each lamp having power supply terminals across which an operating voltage may be applied, comprising:

a sensing unit for each lamp for sensing an intensity of luminous flux emitted by each lamp and for generating an intensity information signal;

means connected to each lamp for detecting a value of said operating voltage and for generating a voltage information signal;

processing means for each lamp for receiving said intensity information signal and said voltage information signal and for determining an efficiency index;

a concentrator receiving the efficiency indices from said plurality of lamps in said public lighting network and for supplying the efficiency indices to a central monitoring station;

said central monitoring station monitoring the state of operation for the plurality of lamps based upon said efficiency indices received from said concentrator.

13. The system as set forth in claim 12, further comprising a plurality of concentrators each connected to a respective plurality of lamps.

14. The system as set forth in claim 12, wherein said sensing unit, comprises a member for directing light from within a lamp housing to an optical fiber.

15. The system as set forth in claim 12, wherein said sensing unit and said detecting means transmit said intensity information signal and said voltage information signal over a power line connected to said terminals of said lamp.

* * * * *